US005405023A

United States Patent [19]

Murakami

[11] Patent Number: 5,405,023

[45] Date of Patent: Apr. 11, 1995

[54] GRAVITY-FEED CHUTE-RACK STORAGE SYSTEM

[75] Inventor: Takeyasu Murakami, Shizuoka, Japan

[73] Assignee: Yazaki Industrial Chemical Co. Ltd., Shizuoka, Japan

[21] Appl. No.: 157,303

[22] Filed: Nov. 26, 1993

[51] Int. Cl.[6] ..... A47F 7/00

[52] U.S. Cl. ..... 211/59.2; 193/2 B

[58] Field of Search ..... 211/59.2, 151; 312/42, 312/35; 193/2 B, 2 R; 198/533

[56] References Cited

U.S. PATENT DOCUMENTS

| | | | |
|---|---|---|---|
| 4,474,297 | 10/1984 | Zucker | 211/59.2 |
| 4,809,839 | 3/1989 | Elliott | 193/2 B X |
| 5,123,545 | 6/1992 | Hickman | 211/59.2 |
| 5,201,429 | 4/1993 | Hikosaka et al. | 211/59.2 |
| 5,314,078 | 5/1994 | Morikiyo et al. | 211/59.2 |

*Primary Examiner*—Robert W. Gibson, Jr.
*Attorney, Agent, or Firm*—Eric P. Schellin

[57] ABSTRACT

A gravity-feed chute-rack storage system is provided with at least two pairs of longitudinal chute-rack rails in the form of two chute-rack pipes sheathed in a plastic resin material having good sliding properties to form a chute-rack unit. Rail supporting members on at least the front and rear sides among the front, intermediate and rear sides of the chute-rack unit are coupled together with at least one vertical coupling member. Further, a vibrator is fitted to any one of the rail supporting members so as to help stock smoothly slide thereon by transmitting vibrations from the vibrator to each chute-rack rail efficiently via the vertical coupling member and the respective rail supporting members. Accordingly, stock efficiency is made improvable without reducing work efficiency as a result of wasteful moves on the part of workers.

4 Claims, 3 Drawing Sheets

GRAVITY-FEED CHUTE-RACK STORAGE SYSTEM

BACKGROUND OF THE INVENTION

1) Field of the Invention

The present invention relates to a gravity-feed chute-rack storage system which is installed in the neighborhood of automotive or electric production lines and permits relatively lightweight assembly parts shelved to be selectively picked up.

2) Description of the Prior Art

While gravity-feed flow-rack storage systems making use of plastic conveyor rails are mainly employed in the industrial world, chute-rack units have recently become known in view of cost-saving as those for use in making lightweight, relatively large bare parts flow on production lines, thus dispensing with not only containers themselves but also the step of recovering them. A chute-rack unit of the sort that utilizes rack rails is formed with thin-wall steel pipes sheathed in a plastic resin material having excellent sliding properties (Japanese Utility Model Laid-Open No. 169518/1989).

More specifically, the chute-rack unit is formed by uprightly setting two square, side frames adequately spaced apart, the side frame being formed with a thin-wall steel pipe sheathed in a plastic resin material, for example. The top and bottom parts of the side frames are coupled together with a plurality of horizontal coupling members similar in structure to the pipe mentioned above to form a chute-rack unit. Moreover, a multi-tier rail supporting members similar in structure to the pipe is horizontally fitted onto the front, intermediate and rear sides of the chute-rack unit. Between the rail supporting members are rack rails in the form of two pairs of chute pipes, each being formed with a thin-wall steel pipe sheathed in a plastic resin material of such as high-density polyethylene or nylon having good sliding properties. Further, the pairs of chute pipes are tilted forward and adequately spaced apart to prevent stock (parts to be assembled) from falling therethrough.

Notwithstanding, there may arise inconvenience in that the number of shelves has to be reduced, thus decreasing stock efficiency, because a gradient of 10°–15° is required for the chute-rack unit above to let relatively heavy articles of stock slide smoothly thereon and 15°–30° to let single lightweight bare articles of stock slide likewise in comparison with a gradient of 3° or thereabout in the case of plastic conveyor rails, though the conventional chute-rack unit is advantageous in cost to what employs the plastic conveyor rails.

On the other hand, the sliding performance of stock may be reduced as the gradient of each rack rail is decreased in order to increase stock efficiency. In other words, the worker involved in taking out stock is compelled to make waste moves, which will also result in reducing workability, as he is supposed to swing the whole chute-rack unit from the unloading port, hook the stock by means of a bar or otherwise making a supplier of the stock use a rod to push the stock.

SUMMARY OF THE INVENTION

An object of the present invention is to provide a gravity-feed chute-rack storage system capable of increasing stock efficiency without lowering work efficiency as a result of wasteful moves on the part of workers.

Another object of the present invention is to cause vibrations produced by a vibrator to be efficiently transmitted to each of the rack rails to help stock smoothly slide thereon.

Still another object of the present invention is to make uniform the effect of vibrations directed to rack rails in each tier by rendering the gradient of each rack rail variable when articles of stock differ in weight or to decrease the height of a chute-rack unit when the articles thereof are the same in weight.

A further object of the present invention is to cause vibrations directed to rack rails to be increasingly amplified by separating rail supporting members in each tier above those in the lowermost tier from each other between chute-rack rails.

Still a further object of the present invention is to cause vibrations directed to rack rails to be directly transmitted to the rack rails without being restricted by the joints coupled thereto by arranging rail supporting members in each tier above those in the lowermost tier on the intermediate and rear sides, excluding the front side, of a chute-rack unit to be supported continuously and coupling the rail supporting members to and supporting them by the respective side frames slidably within a predetermined vertical range.

BRIEF EXPLANATION OF THE ACCOMPANYING DRAWINGS

DESCRIPTION OF THE PREFERRED EMBODIMENTS

Referring to the accompanying drawings, an embodiment of the present invention will subsequently be described.

Figure 1:
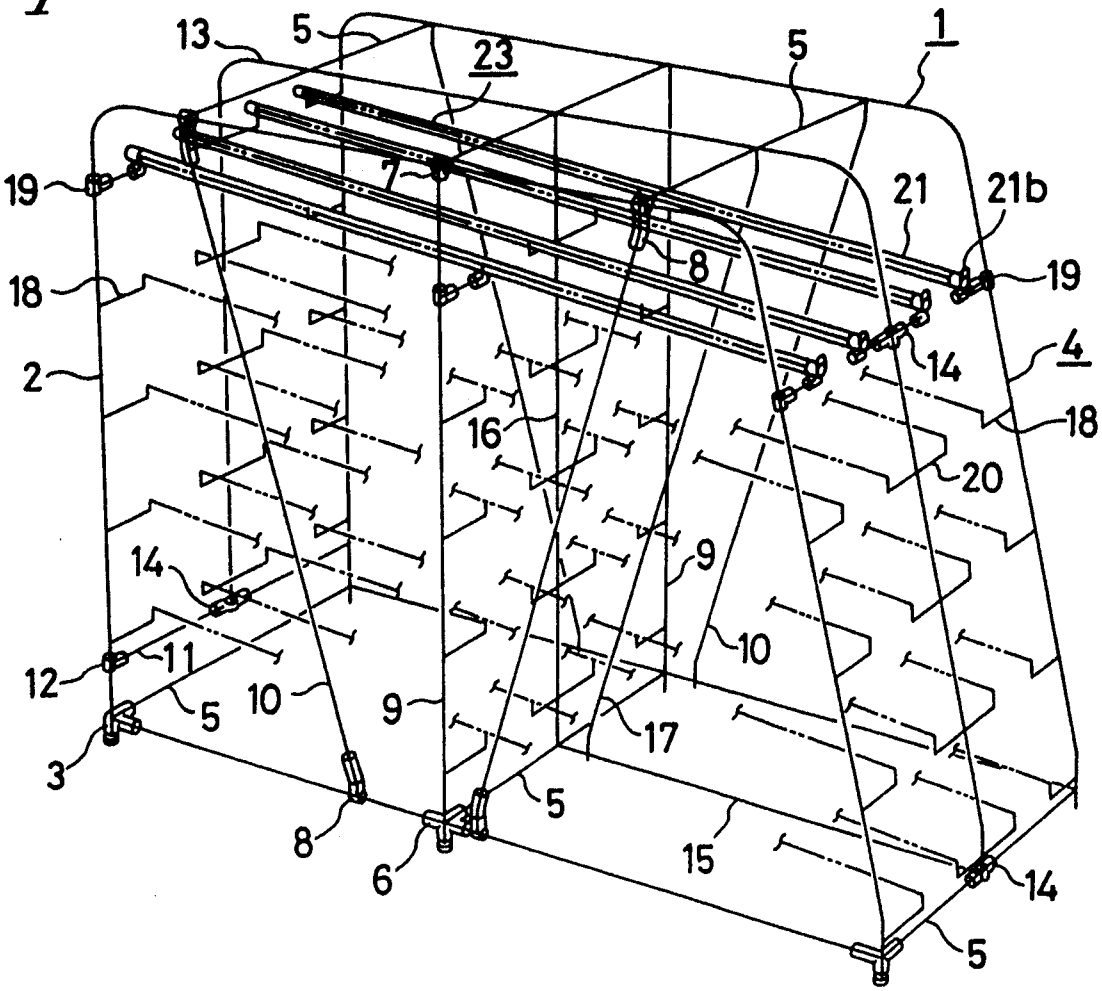
FIG. 1 is a schematic perspective view of a gravity-feed chute-rack storage system embodying the present invention.
Figure 2:
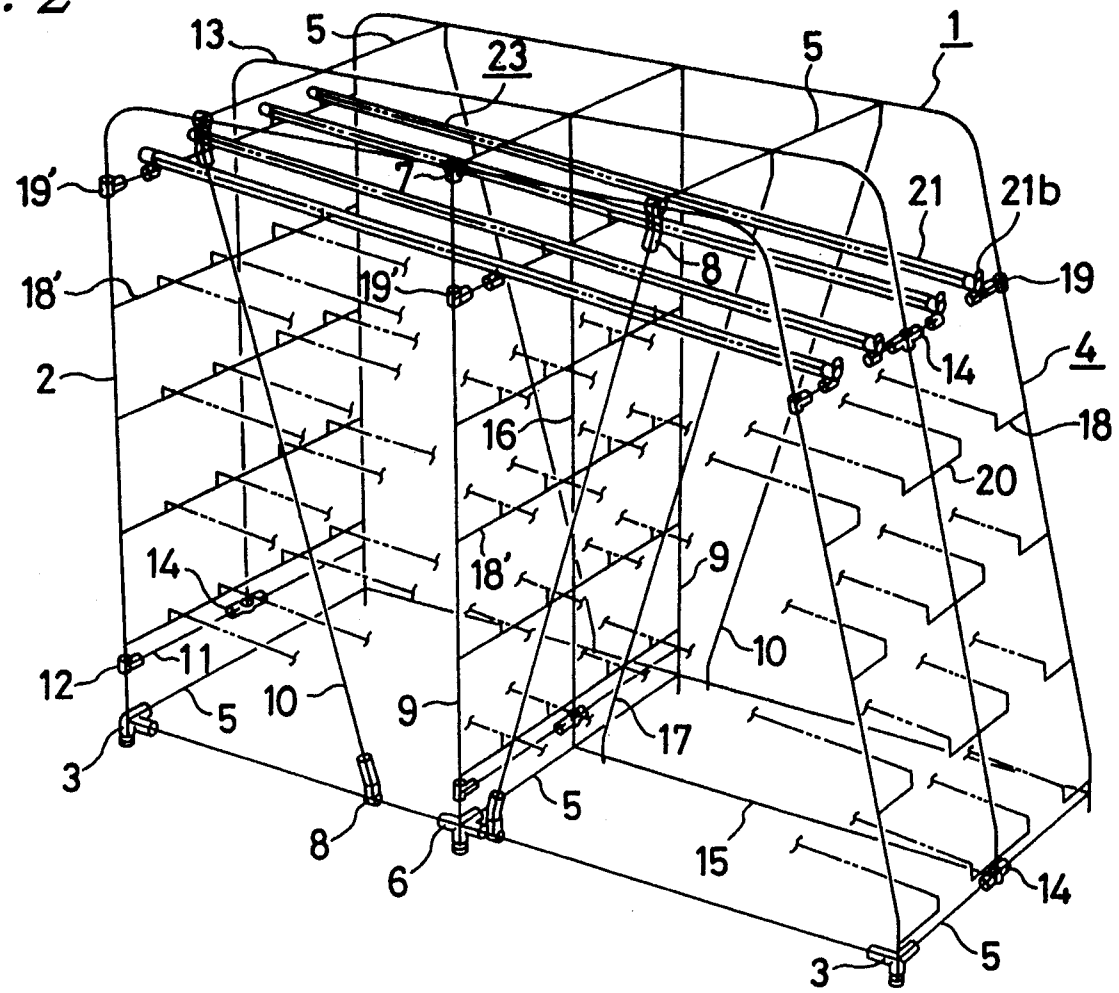
FIG. 2 is a schematic perspective view of another gravity-feed chute-rack storage system embodying the present invention.
Figure 3:
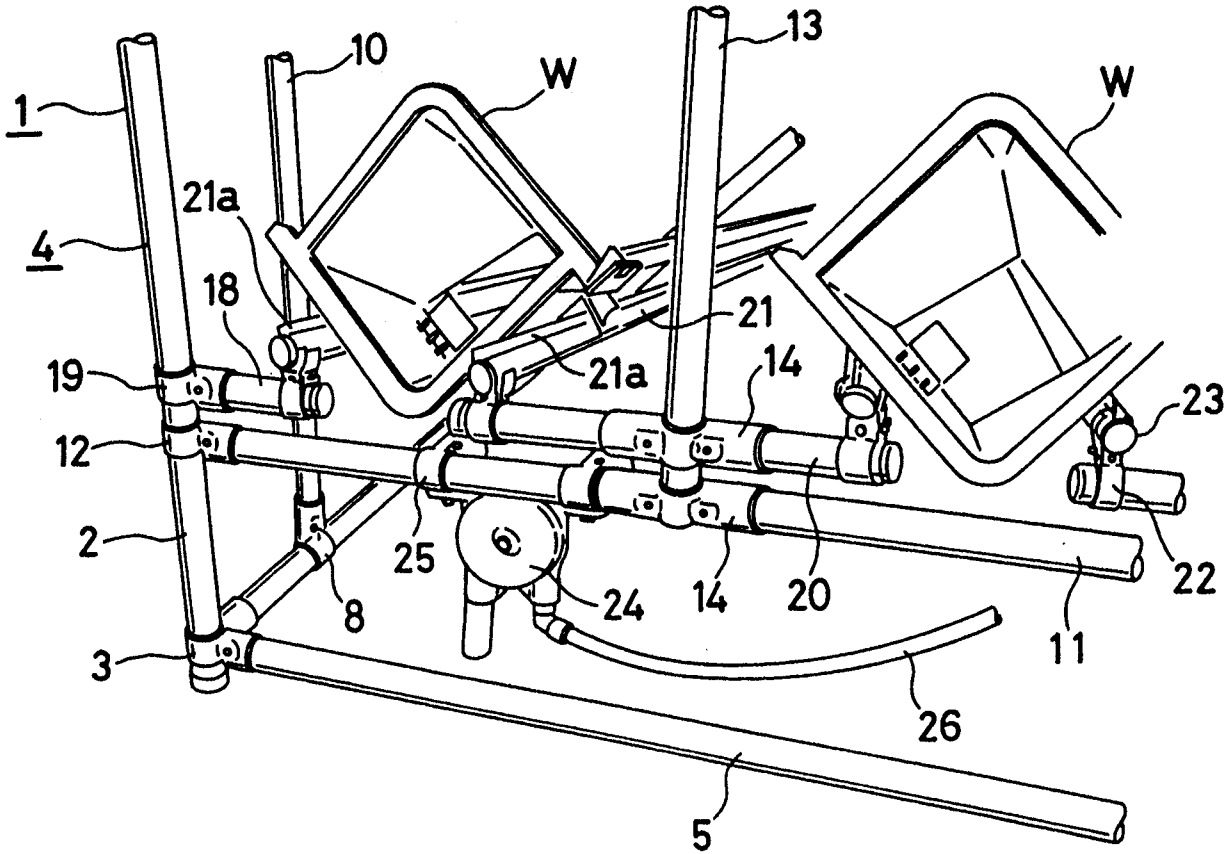
FIG. 3 is an enlarged perspective view of the principal part of the gravity-feed chute-rack storage system shown in FIGS. 1 and 2.

FIG. 1 is a schematic perspective view of a gravity-feed chute-rack storage system embodying the present invention. FIG. 2 is a schematic perspective view of another gravity-feed chute-rack storage system embodying the present invention. FIG. 3 is an enlarged perspective view of the principal part of the gravity-feed chute-rack storage system shown in FIGS. 1 and 2.

In FIG. 1, numeral 1 denotes a chute-rack unit formed of metal pipes 2, each of which is approximately 28 mm in external diameter and made by sheathing a thin-wall steel pipe in a thin, uniform plastic resin material of such as ASA (Acrylate Styrene Acrylonitrile copolymer) in order to make it lightweight and rust-proof. More specifically, a metal or engineering plastic, disintegrable joints 3 (hereinafter simply called the "metal joint") are used to couple two trapezoidal side frames 4 uprightly which are adequately separated from each other in the horizontal direction, the front side of each side frame (on the right-hand side of FIG. 1) being inclined rearward. Further, their top and bottom parts on the front, intermediate and rear sides of the chute-rack unit are coupled together by means of three horizontal coupling members 5 which are similar in structure to the pipe 2 via the joints 3 and metal joints 6, 7, 8.

The intermediate portions of the side frames 4 of the chute-rack unit 1 are vertically coupled together by vertical coupling members 9 similar in structure to the pipe 2 via the joints 6, 7. Moreover, diagonal reinforcing pipes 10 similar in structure to the pipe 2 couple via the joints 8 the top and bottom parts of the respective side frames 4.

An intermediate frame supporting members 11 similar in structure to the pipe 2 is positioned adequately above the horizontal coupling members 5 and horizontally secured via metal joints 12 between both side frames 4 on the rear side of the chute-rack unit 1. Moreover, an inverted U-shaped intermediate frame 13 which is similar in structure to the pipe 2 and modeled substantially after the side frame 4 in configuration is mated via metal joints 14 with the mid portions of the intermediate frame supporting member 11, the horizontal top coupling member 5 and the front horizontal bottom coupling member 5.

The intermediate frame 13 forms a part of the chute-rack unit 1 and a cross coupling members 15 similar in structure to the pipe 2 is used to couple the front and intermediate bottom portions of the chute-rack unit 1 via the joint 14.

A vertical coupling member 16 similar in structure to the pipe 2 is used to couple the horizontal coupling members 5 on the respective top and bottom parts of the intermediate frame 13 via the joint 14. Moreover, a diagonal reinforcing pipe 17 similar in structure to the pipe 2 is used to couple the front top part of the vertical coupling member 16 and the cross coupling member 15 together via a joint 8.

The front and rear portions of both frames 4 of the chute-rack unit 1 and the vertical coupling members 9 are horizontally cantilevered via respective metal joints 19 so that five (5) rail support members 18 similar in structure to the pipe 2 may be set parallel to any horizontal coupling members 5, whereas the front and rear portions of the intermediate frame 13 and the vertical coupling 16 are supported crosswise via the joints 14 so that five (5) rail supporting members 20 similar in structure to the pipe 2 may be set parallel to any horizontal coupling members 5.

Between the side frames 4 facing each other, between the front and rear parts of the intermediate frame 13 and between the rail supporting members 18, 20 in each tier of the vertical coupling members 9, 16 are rack rails 23 formed with pairs of chute pipes 21, each being 38–42 mm in external diameter and made by sheathing a thin-wall steel pipe in a uniform plastic resin material of such as high-density polyethylene or nylon having good sliding properties. Further, each chute pipe 21 is provided with a slide face 21*a* approximately 3 mm thick as an integral part formed by diametrically projecting and axially extending a part of the plastic resin material and also provided with a stopper 21*b* at its front end. These chute pipes 21 are tilted forward at a gradient of 3°–4° via respective metal joints 22 and so spaced apart as to prevent stock W from falling therethrough. There are five tiers of rack rails with two pairs of them in each tier in this case.

A vibrator means 24 such a rotary air vibrator for giving each rack rail 23 vibrations in the vertical direction is uprightly fitted via metal fittings to the mid portion of the intermediate frame supporting members 11 on the rear side of the rack unit 1.

The air vibrator 24 operates for a required length of time manually or on receiving a detection signal for sensing the timing of taking out stock W from a sensor installed at each unloading port.

Moreover, vibrations directed to the rack rails may be increasingly amplified by separating the rail supporting members in each tier above those in the lowermost tier from each other between the chute-rack pipes.

In FIG. 3, numeral 26 denotes an air hose for supplying air when such an air vibrator is employed as the vibrator means.

The chute-rack unit thus constructed is used to store articles of stock W by mounting them on the rack rails 23 from its rear side and conveying them one after another toward the respective unloading ports. When the stock W is taken out of the unloading port as assembly work on a production line proceeds, the air vibrator 24 is operated to make the stock W slide on the vibrating rack rails 23 by gravity-feeding to reinforce that it is slidably sent toward the unloading port.

Therefore, workers will be saved a great deal of wasteful moves and this will also result in improving work efficiency. Since the slope of each rack rail 23 is reducible, moreover, stock efficiency may also be increased.

When plastic resin-formed motor-vehicle heater ducts having a weight of 100–150 g were stored as stock W with the following arrangement including spacing 190 mm apart the chute pipes 21 as the rack rails 23, spacing 480 mm apart the side frame 4 and the intermediate frame 13, setting the chute-rack unit 1,650 mm high and 2,000–2,400 mm deep, not only the sliding but also the pickup of the stock was smoothly accomplished on the vibrating rack rails 23 having a gradient of 3°–4°.

While the air vibrator 24 is in operation, it would take approximately three seconds for one piece of heater duct to slide a step forward, provided that it takes approximately 30 seconds for the stock W to slide on rack rails 2,400 mm long and that the heater duct is approximately 250 mm long.

Consequently, the operating time of the air vibrator 24 is determined by the length of the stock W to be stored.

Although a description has been given of a case where one intermediate frame 13 is disposed in between both frames 4 together with two pairs of rack rails 23 in each tier, the present invention is not limited to the arrangement above and there may be installed more than one intermediate frame 13 and more than two pairs of rack rails 23 in each tier.

Moreover, the intermediate frame 13 need not necessarily be inverted U-shaped but may be formed with at least one vertical coupling rod for coupling the respective rail supporting members 20 in at least the front and rear parts among the front, intermediate and rear parts of the intermediate frame 13.

Further, the rail supporting members 18, 20 may be supported continuously without being separated. In this case, the rail supporting members 18' are, as shown in FIG. 2, equivalent to the intermediate and rear portions, excluding the front portion, of the chute-rack unit 1 and coupled to the side frames 4 via respective joints 19 in such a way that they are slidably (and rotatably) supported by respective loose joints 19' each having plastic sleeves (not shown) within a predetermined vertical range.

As a result, vibrations originating from the air vibrator 24 are directly effectively transmitted to the rail supporting members 18' since the loose joints 19' have been slidably supported. The air vibrator 24 can therefore be made compact.

Moreover, the provision of the air vibrator 24 need not necessarily on the rear side of the chute-rack unit 1 but may be on the front or intermediate side thereof. Further, the air vibrator 24 need not necessarily be fitted to the lowermost rail supporting member but may be fitted to any one of the rail supporting members.

When the air vibrator 24 is installed, it is fitted to the intermediate portion of the lowermost rail supporting member in a case where the rail supporting members are continuously supported, whereas it is fitted to the intermediate portion of an intermediate frame supporting member adequately installed above the horizontal coupling member and under the lowermost rail supporting member in a case where the rail supporting members are separately supported.

The air vibrator 24 is not limited to a rotary type but may be of an air cushion, an electro-magnetic or any other suitable type.

The gradient of each rack rail 23 is not limited to 3°–4° but may be made variable, that is, may be set as small as about 1°, depending on the kind of stock W or the time required to take it out.

Further, the gradients of rack rails 23 need not necessarily be set the same in different tiers. Since the vibrations from the air vibrator 24 are effectively transmitted in an upper tier, they may be decreased in the upper tier, provided the weight of stock W, for instance, is the same. When the weight of such stock W differs with the tier, the vibrations directed to the rack rails 23 may be varied so that the effect of vibrations may become uniform in different tiers.

As set forth above, the vibrations from the air vibrator of the chute-rack according to the present invention are efficiently transmitted to each chute-rack rail via the vertical coupling member and the respective rail supporting members so as to promote the sliding of stock, whereby stock efficiency can still be increased by decreasing the gradient of each chute-rack rail without reducing work efficiency as a result of wasteful moves on the part of workers as before.

When the weight of stock differs with the tier, the effect of vibrations directed to the chute-rack rails may be uniformized or when the weight of stock in those tiers is the same, the height of the chute-rack unit may be reduced further by making the gradients of the chuterack rails.

The vibrations directed to the rack rails may be increasingly amplified by separating the rail supporting members in each tier above those in the lowermost tier from each other between the chute-rack pipes or by making such rail supporting members continuous up to both sides frames and also making the joints coupled to both side frames vertically slidable.

Further, by making continuous the rail supporting members up to both side frames and also making the joints for coupling the ends of the rail supporting members to both side frames respectively slideable within a predetermined vertical range, the vibrations directed from the vibrator to the chute-rack rails are directly transmitted thereto without being restricted by the coupled joints, so that the vibrations are effectively transmitted. In addition, the air vibrator can be made compact.

What is claimed is:

1. A gravity-feed chute-rack storage system comprising two square vertical side frames adequately spaced apart, whose top and bottom parts are coupled together by a plurality of horizontal coupling members therebetween to form a chute-rack unit, said side frame being formed with a thin-wall steel pipe sheathed in a plastic resin material, said horizontal coupling member being similar in structure to said pipe, a plurality of horizontal rail supporting members similar in structure to said pipe and used to horizontally couple together at least the front and rear sides among the front, intermediate and rear sides of said chute-rack unit on a multi-tier basis, and at least two pairs of longitudinal chute-rack rails installed between said rail supporting members in each tier on the at least front and rear sides of said chute-rack unit, said rack rails being adequately spaced apart so as to prevent parts or stock thereon from falling therethrough, said rack rail being formed with a thin-wall steel pipe sheathed in a plastic resin material having excellent sliding properties and tilted forward, characterized in that each of said rail supporting members on the at least front and rear sides among the front, intermediate and rear sides of said chute-rack unit is coupled to adjoining rail supporting members by means of at least one vertical coupling member similar in structure to said pipe, and that a vibrator is fitted to said rail supporting member on one of the front, intermediate and rear sides of said chute rack.

2. A gravity-feed chute-rack storage system as claimed in claim 1, wherein the gradient of said rack rail is variably tilted.

3. A gravity-feed chute-rack storage system as claimed in claim 1 or 2, wherein said rail supporting members in each tier above those in the lowermost tier are separated from each other between said chute-rack rails.

4. A gravity-feed chute-rack storage system as claimed in claim 1 or 2, wherein said rail supporting member in each tier above those in the lowermost tier on the intermediate and rear sides, excluding the front side, of said chute-rack unit are supported to horizontally couple throughout the respective side frames and wherein said rail supporting members are coupled to and supported by the respective side frames slidably within a predetermined vertical range.

* * * * *